US012788207B2

(12) United States Patent
Roney

(10) Patent No.: US 12,788,207 B2
(45) Date of Patent: Nov. 10, 2026

(54) WASHING APPLIANCE

(71) Applicant: FISHER & PAYKEL APPLIANCES LIMITED, East Tamaki (NZ)

(72) Inventor: Philip Roney, Derbyshire (GB)

(73) Assignee: FISHER & PAYKEL APPLIANCES LIMITED, Auckland (NZ)

( * ) Notice: Subject to any disclaimer, the term of this patent is extended or adjusted under 35 U.S.C. 154(b) by 179 days.

(21) Appl. No.: 18/723,074

(22) PCT Filed: Dec. 22, 2022

(86) PCT No.: PCT/NZ2022/050177
§ 371 (c)(1),
(2) Date: Jun. 21, 2024

(87) PCT Pub. No.: WO2023/121482
PCT Pub. Date: Jun. 29, 2023

(65) Prior Publication Data

US 2025/0057387 A1 Feb. 20, 2025

(30) Foreign Application Priority Data

Dec. 22, 2021 (NZ) ..... 783815

(51) Int. Cl.
*A47L 15/42* (2006.01)
*A47L 15/00* (2006.01)
*D06F 37/26* (2006.01)

(52) U.S. Cl.
CPC ..... *A47L 15/4246* (2013.01); *A47L 15/0084* (2013.01); *D06F 37/266* (2013.01)

(58) Field of Classification Search
None
See application file for complete search history.

(56) References Cited

U.S. PATENT DOCUMENTS 6,447,081 B1 * 9/2002 Sargeant ..... A47L 15/0084 312/228.1
6,571,808 B2 6/2003 Todd
2006/0151011 A1 * 7/2006 Maunsell ..... A47L 15/4263 134/111

(Continued)

FOREIGN PATENT DOCUMENTS

WO 9312706 A1 7/1993
WO 9833426 A1 8/1998

(Continued)

*Primary Examiner* — Omair Chaudhri
(74) *Attorney, Agent, or Firm* — Clark Hill PLC; James R. Foley

(57) ABSTRACT

In a drawer-style washing appliance, such as a drawer-style dishwasher 100, a tub flange 301 is provided with drainage-facilitating features 167 to encourage draining of any pooled washing liquid on the upper surface of the tub flange during a washing cycle, which would otherwise remain there after opening of the drawer. The drainage features may be one or more ridge 168 or channel on/in the surface of the tub flange, particularly at or about the inner peripheral edge 304 of the tub flange. Alternatively, the drainage-facilitating features may be provided on the underside of the tub lid 201 in a region that will come into contact with the tub flange when the lid is lowered to seal the tub during a washing cycle.

20 Claims, 5 Drawing Sheets

(56) References Cited

U.S. PATENT DOCUMENTS

| | | | | |
|---|---|---|---|---|
| 2015/0376828 | A1* | 12/2015 | Seo | D06F 29/00 68/3 R |
| 2017/0002494 | A1* | 1/2017 | Lee | D06F 34/28 |
| 2020/0024786 | A1* | 1/2020 | Kim | D06F 37/42 |
| 2020/0221919 | A1* | 7/2020 | Lee | A47L 15/0086 |
| 2021/0235962 | A1* | 8/2021 | Mcinerney | A47L 15/4209 |
| 2022/0120022 | A1* | 4/2022 | Lee | D06F 37/266 |

FOREIGN PATENT DOCUMENTS

| | | | |
|---|---|---|---|
| WO | 2008150184 | A1 | 12/2008 |
| WO | 2016130027 | A1 | 8/2016 |

* cited by examiner

WASHING APPLIANCE

This application is a National Phase Filing of PCT/NZ2022/050177, having an international filing date of Dec. 22, 2022, which claims priority of New Zealand Patent Application No. 783815, filed Dec. 22, 2021. The disclosure of the foregoing are hereby incorporated by reference.

TECHNICAL FIELD

The invention relates to a washing appliance such as a dishwasher or laundry washing machine, and more particularly though not solely, to the sealing flange about the upper edge of the tub of a drawer of the washing appliance.

BACKGROUND ART

A drawer-type or drawer-style washing appliance may have one or more retractable drawers. The, or each, drawer may have a washing tub that provides a wash cavity for items, such as dishes, cutlery, or laundry to be washed. The drawer may be withdrawn out of a washing appliance cabinet to provide user access to the tub, and may be retracted into the cabinet to perform a washing operation.

The tub of the drawer is typically moulded from a polymeric or plastics material, or formed from sheet metal such as stainless steel. The tub includes a base and substantially vertical side walls, the upper edges of which support a substantially horizontal flange around the perimeter of the tub opening. The tub flange forms a seal against edges of a vertically-movable lid of the washing appliance, to form a water-tight seal between the lid and the retracted drawer, preventing washing liquid from splashing out of the drawer during a washing operation.

Depending upon the amount of overlap of the flange surface and the lid, there may be a substantial area of the flange that is "inside" the flange/lid seal within the tub, and therefore exposed to the wash liquid, when the lid seal is formed. In such a case, when the washing cycle is completed, the lid raised, and the drawer opened, a residual amount of washing liquid may remain on the tub's flange. Some users find a pool of washing liquid remaining on the tub flange at the end of a washing cycle to be unsightly and some also interpret this as a product fault, resulting in an unnecessary service call. There is also potential that, after opening of the drawer, washing liquid pooling on the tub flange could overflow an outer lip around the flange and make its way onto a user interface or control panel, causing false triggering of capacitive-touch buttons or other electronics problems.

It is an object of the present invention to provide a method of draining pooled water from the tub flange of a drawer-style washing appliance, and a tub flange or lid or washing tub or washing appliance incorporating features that reduce pooled water on the tub flange, or to at least provide the public with a useful alternative assembly method and/or flange/lid/tub/appliance.

SUMMARY OF THE INVENTION

In a first aspect, the invention consists in a tub flange member for a washing tub of a drawer of a drawer-style washing appliance, the tub flange member comprising:

- an attachment side adapted to be attached to the upper edge of side walls of the washing tub, around the periphery of the tub,

- a seal-contacting side, opposite to and spaced away from the attachment side, including a planar region adapted to be contacted by a lid seal for closing the washing tub during a washing cycle of the appliance,
- a peripheral wall, extending from the seal-attachment side toward the attachment side, forming an opening of the washing tub at a peripheral edge between the peripheral wall and the planar region of the seal-attachment side, and
- at least one drainage ridge or channel on or in the peripheral wall and/or the seal-contacting side, at least in the region of the peripheral edge, for channeling liquid from the seal-contacting side to the peripheral wall.

Preferably, the tub flange member is picture frame-shaped, having corner regions.

Preferably, the tub flange member is substantially rectangular- or square-shaped having plural substantially straight sections joined at corner regions of the tub flange member.

Preferably, the at least one drainage ridge or channel is provided at a corner region of the tub flange member.

Preferably, each corner region of the tub flange member is provided with the at least one drainage ridge or channel.

Preferably, the at least one drainage ridge or channel extends continuously along both the peripheral wall and the planar region of the seal-contacting side.

Preferably, the at least one drainage ridge or channel comprises plural parallel ridges, preferably three parallel ridges, protruding above the surface of the tub flange member.

Preferably, the parallel ridges are substantially vertically aligned on the peripheral wall.

In a second aspect, the invention consists in a washing tub for a drawer of a drawer-style dishwasher, the washing tub comprising:

- a base and substantially vertical side walls, the upper edges of which support a tub flange member according to the first embodiment around the perimeter of an opening of the tub.

In a third aspect, the invention consists in a tub lid for closing an open top of a washing tub of a drawer of a drawer-style washing appliance, the tub lid comprising:

- a central, substantially planar, region,
- a peripheral sealing portion, the underside of which is adapted to engage with an upper surface of a tub flange of the washing tub by being pressed thereagainst,
- a bridging portion connecting the central portion to the peripheral sealing portion, the bridging portion, in cross-section, having a concertina structure of panel members, adjacent panel members connected at a hinge region to enable flexibility in the spacing and relative arrangement of the central and peripheral sealing portions, and
- at least one drainage-facilitating rib spanning between a pair of adjacent panel members on the underside of the bridging portion and extending away from the underside thereof,
- wherein the at least one drainage-facilitating rib is adapted to contact the upper surface and/or an inner peripheral edge of the tub flange when the peripheral sealing portion is pressed thereagainst so as to facilitate drainage of any liquid pooled on the upper surface of the tub flange.

Preferably, the at least one drainage-facilitating rib is integrally formed with the bridging portion from an inherently flexible material, such as an elastomeric material.

Preferably, the at least one drainage-facilitating rib extends in a plane substantially perpendicularly to the plane of the central region, and is formed from a material with at least some inherent flexibility, such as an elastomeric material, so that the rib will deform upon engagement with the upper surface of the tub flange.

Preferably, the at least one drainage-facilitating rib has a lower edge adapted to contact the upper surface and/or inner peripheral edge of the tub flange, the lower edge having a cut-out portion to facilitate hinging of the pair of adjacent panel members of the bridging portion by enabling the rib to deform.

Preferably, the tub lid is substantially rectangular or square-shaped in plan view, having four corner regions, and a drainage-facilitating rib is provided at least one of the corner regions.

In a fourth aspect, the invention consists in a drawer-style washing appliance comprising a cabinet and a drawer containing a washing tub, the drawer having a sliding configuration with the cabinet such that the drawer can be slid to an open position relative the cabinet to access an interior of the tub, and such that the drawer can be slid to a closed position relative to the cabinet to enable a washing operation to be performed, the tub having either or both of:

a tub flange according to the first aspect, or a tub lid according to the third aspect.

Preferably, the washing appliance is a dishwasher or a laundry washing machine.

This invention may also be said broadly to consist in the parts, elements and features referred to or indicated in the specification of the application, individually or collectively, and any or all combinations of any two or more said parts, elements or features. Where specific integers are mentioned herein which have known equivalents in the art to which this invention relates, such known equivalents are deemed to be incorporated herein as if individually set forth.

The term 'comprising' as used in this specification means 'consisting at least in part of'. When interpreting each statement in this specification that includes the term 'comprising', features other than that or those prefaced by the term may also be present. Related terms such as 'comprise' and 'comprises' are to be interpreted in the same manner.

As used herein the term '(s)' following a noun means the plural and/or singular form of that noun. As used herein the term 'and/or' means 'and' or 'or', or where the context allows, both.

The invention consists in the foregoing and also envisages constructions of which the following gives examples only.

BRIEF DESCRIPTION OF DRAWINGS

Embodiments of the invention will now be described with reference to the accompanying drawings by way of example, in which.

DESCRIPTION OF EMBODIMENTS

Figure 1:
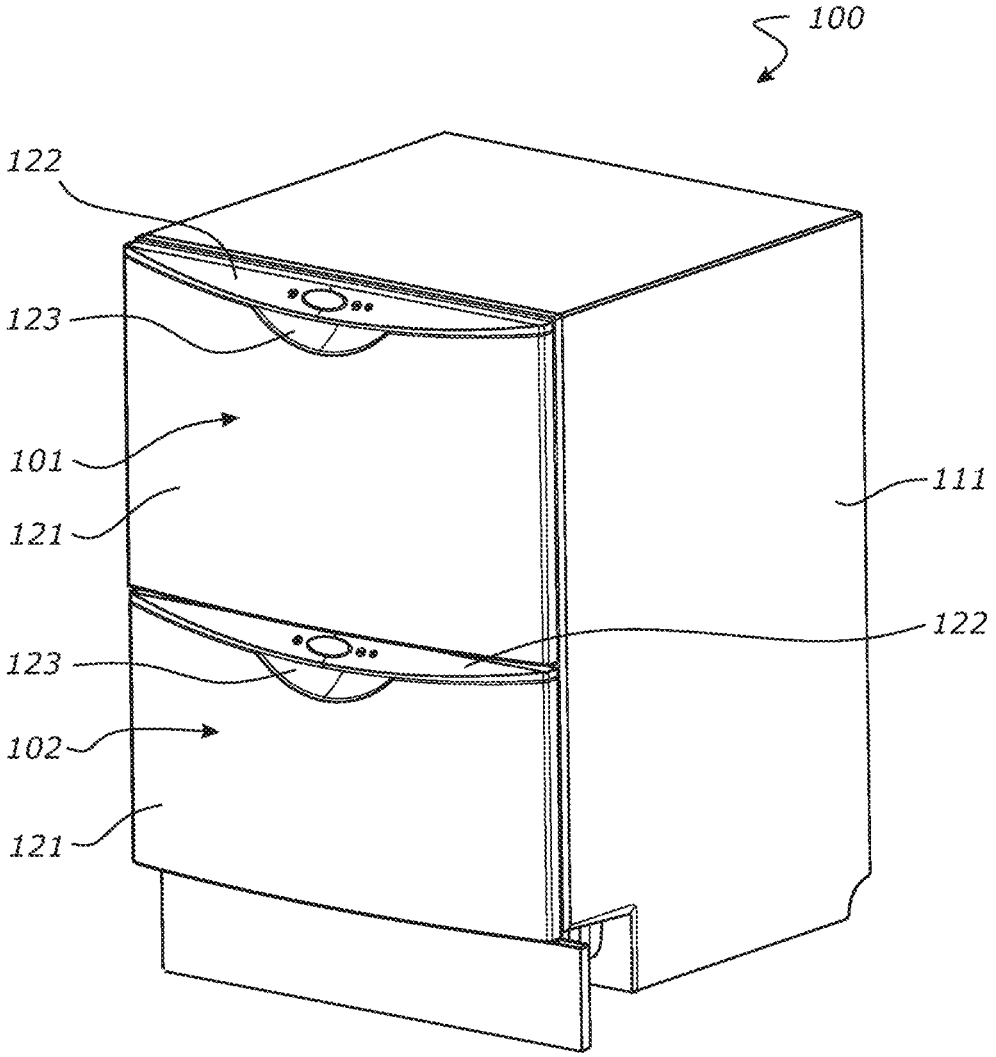
FIG. 1 is a perspective view from the front of a drawer-type washing appliance in the form of a dishwasher.

FIG. 1 shows as an exemplary drawer-type washing appliance. The washing appliance is a dishwasher 100 of the drawer-type or drawer-style such as our DISHDRAWER™ dishwasher. In addition to the features described in this specification, the washing appliance could have any one or more of the features and functionality described in our prior patent publications WO9323706A1, WO9833426A1, WO2008150184A1, U.S. Pat. No. 6,571,808B2 and WO2016130027A1, the entire content of each of which is incorporated by reference herein.

Figure 2:
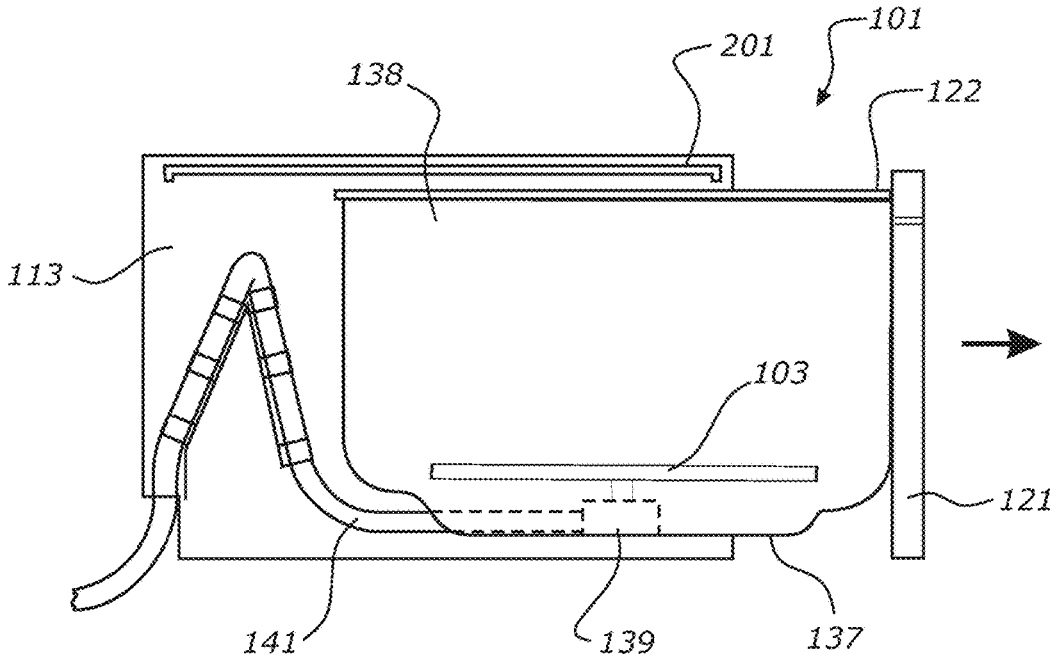
FIG. 2 is a left-side sectional schematic view of a drawer region of the washing appliance of FIG. 1, showing a drawer being extended from a cabinet and showing a tub lid for sealing the top of the drawer during a washing operation and exemplary plumbing connections to a wash unit at the base of the drawer.
Figure 3:
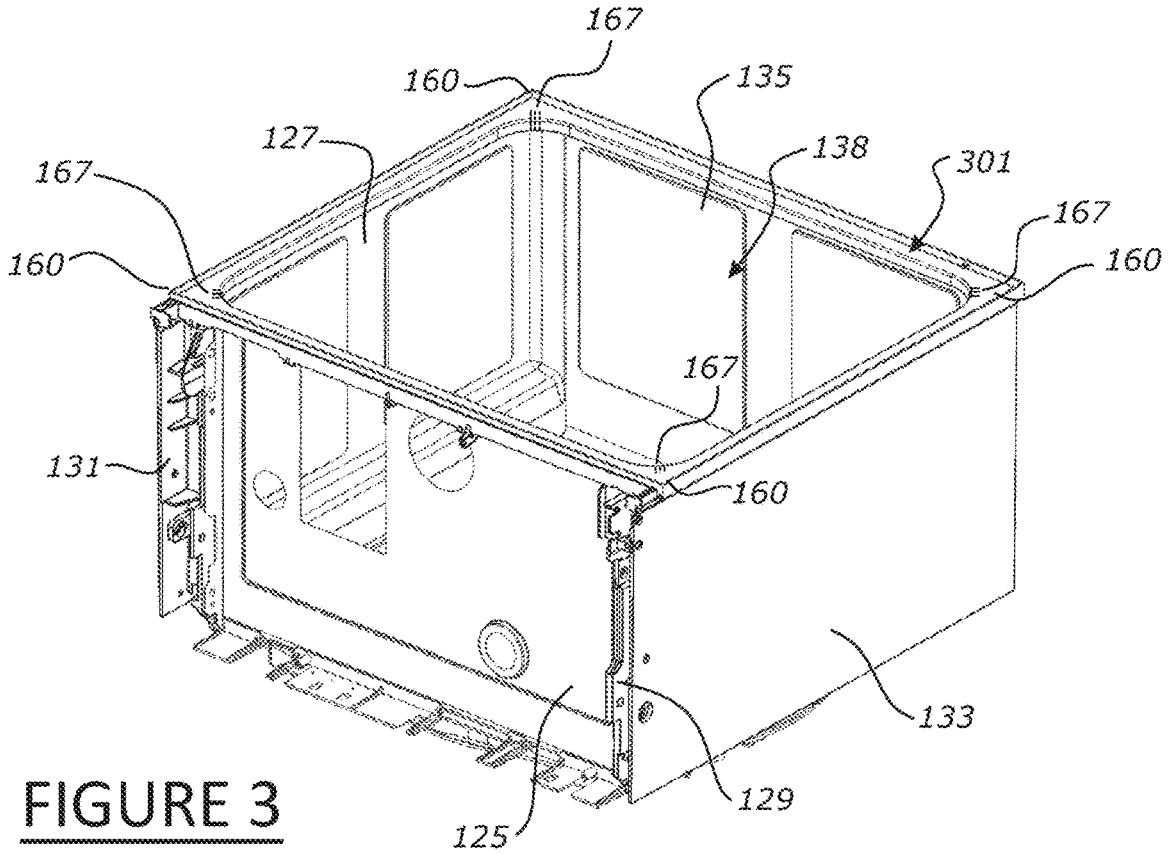
FIG. 3 is a front, right-side perspective view from above of the drawer of the a washing appliance such as that shown in FIG. 1, with a front panel not shown, and incorporating the tub flange drainage ribs in accordance with an embodiment of the present invention.

A double-drawer dishwasher is shown in FIG. 1, with both the lower drawer 101 and upper drawer 102 closed. Each drawer 101, 102 (a single one of which is shown in FIGS. 2 and 3) is slidably mounted within a chassis 113 in an outer cabinet 111 in a drawer-style arrangement, such as on drawer runners. The washing appliance may be sold as a single-drawer version or as a double-drawer version. With reference to FIGS. 1 to 3, each drawer 101, 102 comprises a front panel 121 which may have a handle 123 for a user to grasp, an internal front wall 125 behind the front panel 121, left and right side inner walls 127 and 129 and left and right side outer walls 131 and 133, an internal rear wall 135, and a base 137. Left and right side outer walls 131, 133 may be metal or plastics. The internal walls 125, 127, 129, 135 and base 137 form a washing tub 138 that defines a washing chamber or washing space having an open top, within the or each drawer.

In use, the wash drawer 101, 102 is slidingly withdrawn from the chassis 113 and outer cabinet 111 for loading and unloading dishes or cutlery, and when loaded or empty is pushed home into the outer cabinet 111 to close the drawer, and to enable washing to occur when loaded. When the wash drawer is retracted home in the outer cabinet 111 the open top of the drawer is closed by a vertically-movable internal lid 201.

The, or each, drawer comprises an associated wash system including a wash unit 139 (FIG. 2) that mounts to the base 137 of the drawer. The wash unit 139 comprises suitable components such as a water inlet valve, rotating spray arm 103 (which, in operation, directs washing liquid, such as a water and detergent mixture, upwardly onto items in the washing space), drain valve, heater, filtration system, and conduit(s) 141 to deliver and remove washing liquid. Washing operations may be initiated via a user interface (UI) panel 122 on a front surface of the drawer (as shown in the FIG. 1 embodiment) or on/adjacent an upper surface/edge of front panel 121 (see FIGS. 2 and 5, for example) which is only visible to a user when the drawer has been withdrawn from the cabinet. UI panel 122 may incorporate a display and/or buttons allowing a user to interact with an appliance controller (not shown) to initiate/modify/pause appliance operations in the known way.

A drawer-type dishwasher is referred to by way of example only. The features described herein could alternatively be used in a different type of washing appliance, such as a drawer-type laundry washing machine. The dishwasher or other type of washing appliance could have one drawer, two drawers, or three or more drawers. While features are described in detail below with reference to drawer 101, the other drawer 102 (and indeed other drawers if three or more drawers are provided) may have the same features.

The drawer 101 includes the tub 138 which could be formed via plastics injection moulding, or preferably comprises metal material such as stainless steel or alloy metal material. In the form shown, the tub 138 comprises a generally square or rectangular shape in plan view, with four upstanding internal walls 125, 127, 129 and 135. However, the tub 138 could have any suitable shape. For example, the tub 138 could comprise a generally elliptical or round shape in plan view, with the base 137 and one upstanding internal wall extending upwardly from the perimeter of the base 137. The wall(s) 125, 127, 129 and 135 could extend vertically upward from the base 137 or alternatively could extend upwardly at an angle that is offset from vertical.

The metal body of the tub 138 may consist essentially of a single metal formed (such as pressed) component comprising the internal wall(s) 125, 127, 129, 135 and base 137. Alternatively, the tub 138 may comprise a plurality of metal wall/base components that are attached, bonded, fastened or connected together such that the tub has a metal base 137 panel and one or more wall panels 125, 127, 129 and 135. The plurality of metal components may be welded together, and in one configuration may be laser-welded together.

Figure 4:
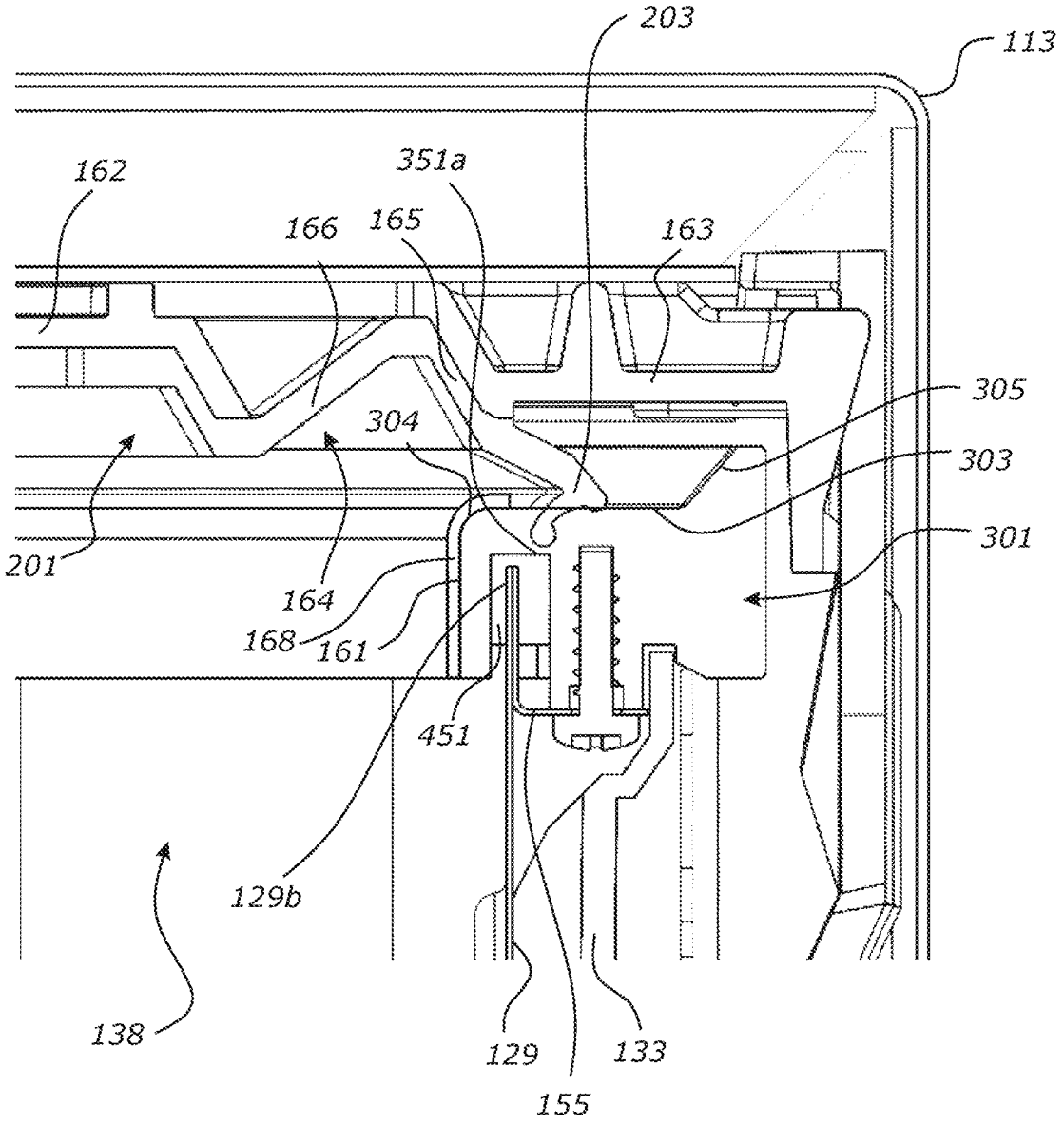
FIG. 4 is a front cross-sectional view of a region of the drawer in the washing appliance of FIG. 3, showing the lid seal engaging against the flange.

As best shown in FIG. 4, each wall 125, 127, 129 and 135 of tub 138 comprises a respective upper free edge such as edge 129*b*. At least one bracket, such as a right-side bracket 155 is attached to an exterior side of one or more wall of the tub 138. The bracket(s), such as right-side bracket 155 comprise(s) a metal material such as stainless steel. The bracket(s) may be attached to the exterior of the tub using any suitable technique, such as by connectors or fasteners or welding. In one configuration, the bracket(s) such as bracket 155 is/are attached to the exterior of the tub by laser welding.

Each bracket is attached to its respective wall at or adjacent to the upper free edge. A tub flange member 301 (hereinafter referred to simply as flange 301 or "the flange") comprising plastics material is mounted to the top of the washing tub 138 by being connected to the bracket(s) on wall 129. Flange 301 may comprise any suitable plastics, elastomeric or rubber material. For example, the flange may comprise Polypropylene 20% Talc-filled material or a NORYL™ resin. Flange 301 has a shape, in plan view, corresponding substantially to the shape of the top/periphery of the tub 138. Therefore, for a generally square or rectangular tub (in plan view), the flange will have a generally square, rectangular or "picture frame"-shape from above. More generally, flange 301 could be described as polygonal in shape, having a plurality of sides surrounding a central opening. If the tub shape (in plan view) is circular or oval, then the flange would be annular or oblong in shape.

In the form shown in FIGS. 4-6 and 8, for example, flange 301 has a front portion 311, left side portion 313, right side portion 315, and rear portion 317 corresponding to a front bracket, a left side bracket, the right side bracket 155, and a rear bracket, respectively. Adjacent pairs of the four flange portions, or sections, 311, 313, 315 and 317 are connected together at corner regions 160 and together define an opening at an inner peripheral edge or rim 304 to provide access to the interior of the tub from above when the flange 311 is mounted to the tub 138. The peripheral edge may have a substantially square profile or it may be bevelled or curved.

An upper surface of the flange 301, on a seal-contacting side of the flange, has a substantially flat or planar upper sealing surface or region 303 that is surrounded on its outside by a peripheral upstanding lip 305. As shown in FIG. 4, the upper sealing surface 303 engages against a downwardly-oriented sealing member 203 on the periphery of the lid 201 when the lid is closed onto the top of the flange 301 to close and seal against the tub 138 during a washing operation.

The flange 301 can be connected to an upper surface of the tub bracket(s) (such as bracket 155) using any suitable technique such as by fasteners, clipping or heat-staking plastics flange pins positioned through holes in the flange. FIG. 4 illustrates an embodiment wherein the tub flange is fastened to the tub side walls via screws passing upwardly through openings in the tub bracket(s) and into the underside, or attachment side, of the tub flange. The attachment side is opposite to and spaced away from the seal-contacting side by a distance of, for example, 10 mm to 30 mm. A substantially vertically-aligned peripheral wall extends between the attachment side and the sealing surface 303 on the seal-contacting side, with edge 304 forming the interface between the peripheral wall and the sealing surface.

The attachment side of flange 301 has one or more downwardly-open grooves, slots or channels, such as channel 315*a* shown in FIG. 4, for receipt of an upper free edge or edges of the tub walls, such as free end 129*b*. Preferably, the end of each channel connects to the end of the two adjacent channels to form one continuous channel around the underside of the flange. Alternatively, the channels may be discreet and not connect to each other.

Referring to FIG. 4, a sealing adhesive 451 is deposited in the channel 315*a* that adheres the tub wall upper free edge(s) to the flange 301. The sealing adhesive also provides a seal between the flange 301 and the upper free edge(s) of the wall(s) in the channel(s). Still further, the sealing adhesive also provides a secondary attachment or connection between the upper free edge(s) of the wall(s), and the bracket(s), and the flange 301.

The UI panel 122, as mentioned above, may be hidden from view when the drawer is retracted by being located at, along or adjacent to an upper edge of front panel 121. More specifically, the UI panel 122 may be part of a UI module 200 (see FIG. 5) that may house the appliance controller, a display screen, buttons and other electronics for the appliance. The UI module 200 may be an elongate component that is clipped and/or fastened to the front edge of flange 301 and alignment/securement features/brackets 202 may be provided on, or formed as part of, flange 301 for this purpose. The UI module therefore spans a space between flange 301 and the inner side of the front panel 121.

The upper face of the UI module may be covered by a clear, plastics interface lens which is bonded and/or sealed to the remainder of the UI module. Of course, the components housed within UI module 200 could be housed within the frontmost (that is, nearest the front panel 121) span of flange 301 with the plastics interface lens bonded and/or sealed to the flange. However, when the flange is formed from polypropylene, sealing/bonding the lens can be difficult and so utilising a separate UI module 200 is advantageous and allows for replacement of the UI module if necessary.

The lid 201 of the washing appliance is configured to engage with the upper surface 303 of the flange 301 during the washing operation. The lid may be configured to automatically engage with the upper surface of the flange when the user instructs the wash operation using the UI panel (122). The lid 201 may be vertically movable between a raised position in which it does not contact the flange 301 to enable the drawer 101, 102 to be withdrawn or closed, and a lowered position for the washing operation. The cabinet 111 may have a motorised configuration to move the lid 201 up and down. By way of example, the lid may be moved using the arrangement described in our aforementioned patent U.S. Pat. No. 6,571,808B2.

As, for example, described in an embodiment of the aforementioned WO2008150184A1, lid 201 has a central substantially planar region 162 surrounded by an outer, peripheral frame 163 acting as a sealing portion, the underside of which carries the downwardly-oriented sealing member 203. The central and outer regions of the lid are substantially rigid and are connected by a flexible, bridging region 164. Bridging portion 164, in cross-section, has a bellows or concertina-like structure of panel members 165, 166 hingedly connected, integrally, at their adjacent edges. The structure and material of the bridging portion enables, during lowering of the lid, the central region to stop moving if it contacts a large item within the tub, while the peripheral sealing portion is still able to be bought into sealing contact with the sealing surface 303 of flange 301.

If sealing member 203 contacts sealing surface 303 too far away from edge 304, when the lid engages the flange, an excessive area of sealing surface 303 is then located within the closed washing space and therefore exposed to washing liquid. In such a situation, washing liquid is able to pool on the sealing surface, as previously discussed. This can occur through manufacturing tolerances or misalignment of lid and flange. Ideally, seal member 203 would engage sealing surface 303 as close as practicable to edge 304, thus avoiding or minimising any pooled washing liquid.

Figure 5:
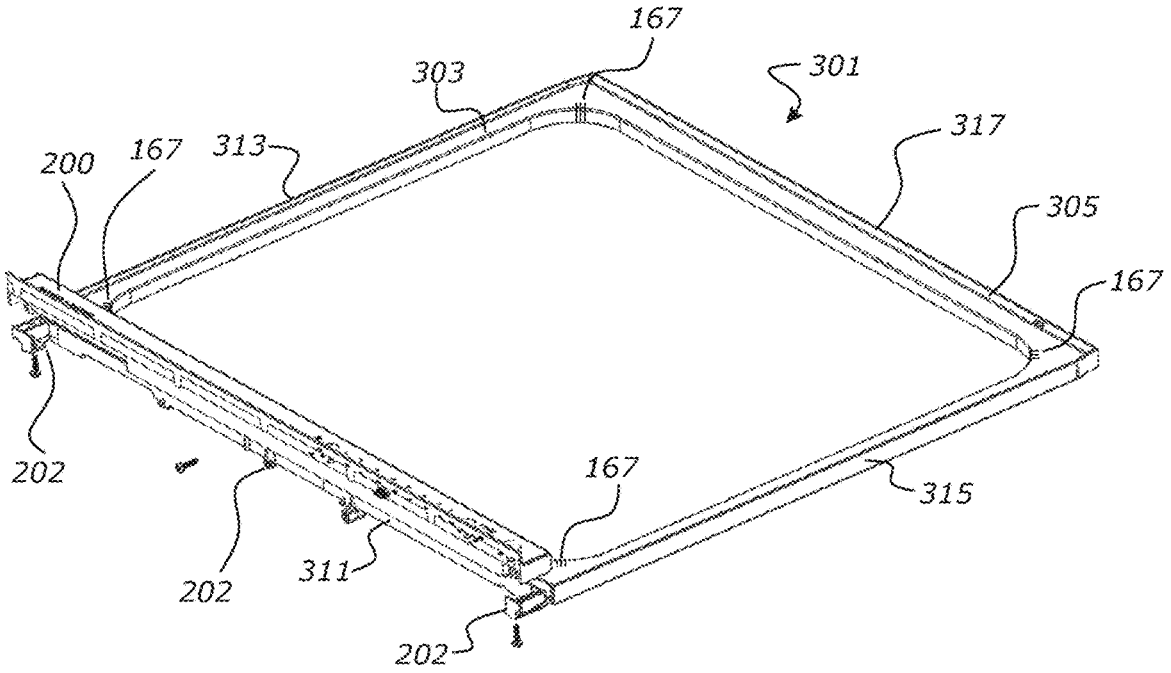
FIG. 5 is a front-right perspective view from above of the tub flange and UI of the drawer of FIG. 3.

To remove or minimise washing liquid that is pooled on sealing surface 303, a drainage feature or features are provided in the vicinity of edge 304. The drainage feature or features are structural modifications to the flange that act passively to drain pooled water into the tub. For example, as shown in FIGS. 3 and 5, the flange may be provided with at least one drainage-facilitating feature 167. FIGS. 3 and 5 have one drainage feature per corner region of flange 301. The drainage feature(s) may be positioned at the corner region(s) of the flange because the corner regions have a greater tendency to pool washing liquid, however, the drainage feature(s) could be positioned elsewhere around the flange's periphery. The drainage features could be provided at only one corner or positioned at the two front corners only, to ensure draining of the most visible part of the flange upon opening of the drawer. Alternatively, as shown in the drawing figures, all four corner regions of the flange may be provided with a drainage feature.

Figure 6:
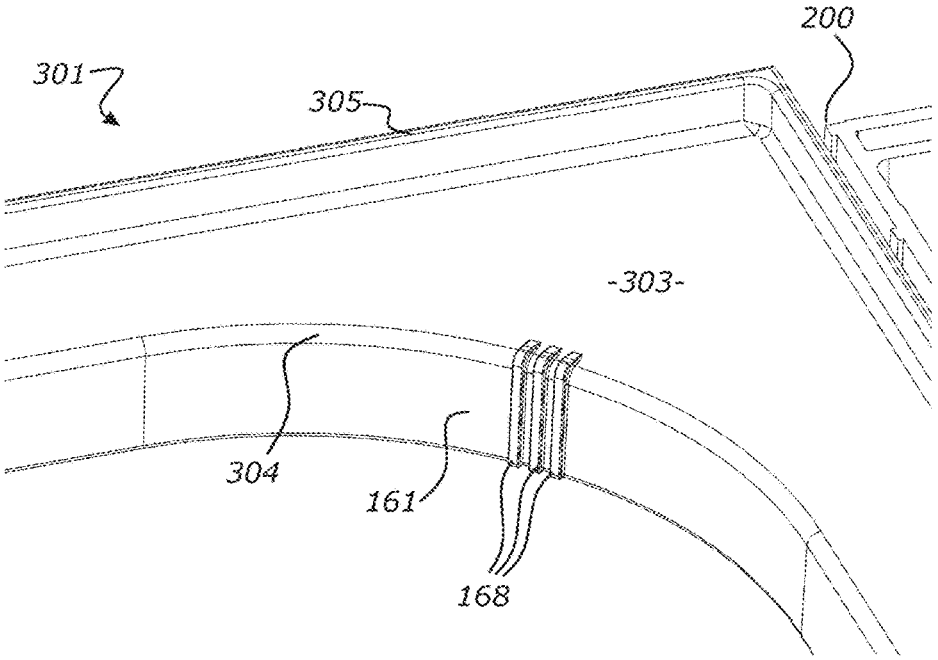
FIG. 6 is an enlarged perspective view of a corner region of the tub flange of FIG. 5, showing the drainage ribs.

As best seen in the exemplary embodiment illustrated in FIGS. 4 and 6, drainage features 167 may comprise at least one drainage rib or ridge 168 which extends above the surface of the flange. Rib or ridge 168 may be oriented in a substantially vertically-aligned plane and extend over at least part of the height of the flange's peripheral wall 161, edge 304 and at least a part of the sealing surface 303. In this way, rib or ridge 168 is able to contact washing liquid pooled on sealing surface 303 and, via capillary action, enable shedding of pooled water along the length of the rib or ridge 168 and into the tub. Ideally, at least two (in the illustrated case, three) parallel ribs or ridges are formed to facilitate drainage of pooled water along the channels between adjacent ribs or ridges 168, via capillary action.

As an example only, the width of each rib or ridge may be about 1 mm and the gap between each rib or ridge may also be about 1 mm. However the rib width may be, for example, between about 0.5 mm and about 3 mm and the gap between adjacent ribs may be, for example, between about 0.5 mm and about 1.5 mm. It is anticipated that it may be possible to drain pool washing liquid if the rib or ridge 168 extends only as high as edge 304, so does not include the substantially horizontal segment on sealing surface 303. Furthermore, although FIGS. 4 and 6 show the upper ends of each rib or ridge sitting proud of the surface of the sealing region 303, they may taper towards their upper ends so that the upper end is flush with the sealing region. In other words, the upper ends of the ribs or ridges effectively end at the point where the curvature/bevel of edge 304 ends and sealing region 303 starts. From an appearance perspective, it is considered that the drainage features as illustrated do not detract significantly from the overall aesthetic appeal of the product, while ensuring successful drainage of any pooled washing liquid.

It will be appreciated that, instead of the raised ribs or ridges 168 illustrated in the drawing figures, the drainage features could be fashioned as slots or channels recessed below the surface of the flange 301, at least in the region of peripheral edge 304, preferably also over at least part of the height of peripheral wall 161 and/or edge 304. Such slots or channels would function in the same way as the aforementioned ribs or ridges, using capillary action to draw water away from the sealing surface 303. Only one slot could be provided, although two or more substantially parallel slots would be preferred.

Figure 7:
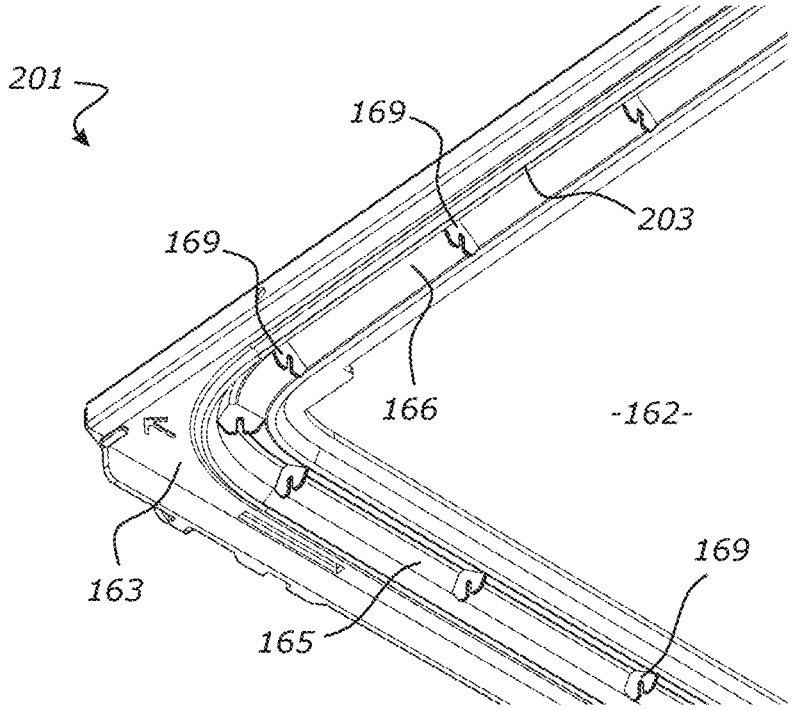
FIG. 7 is a perspective view from beneath of a corner of a tub lid similar to that shown in FIG. 2, showing drainage-facilitating ribs.
Figure 8:
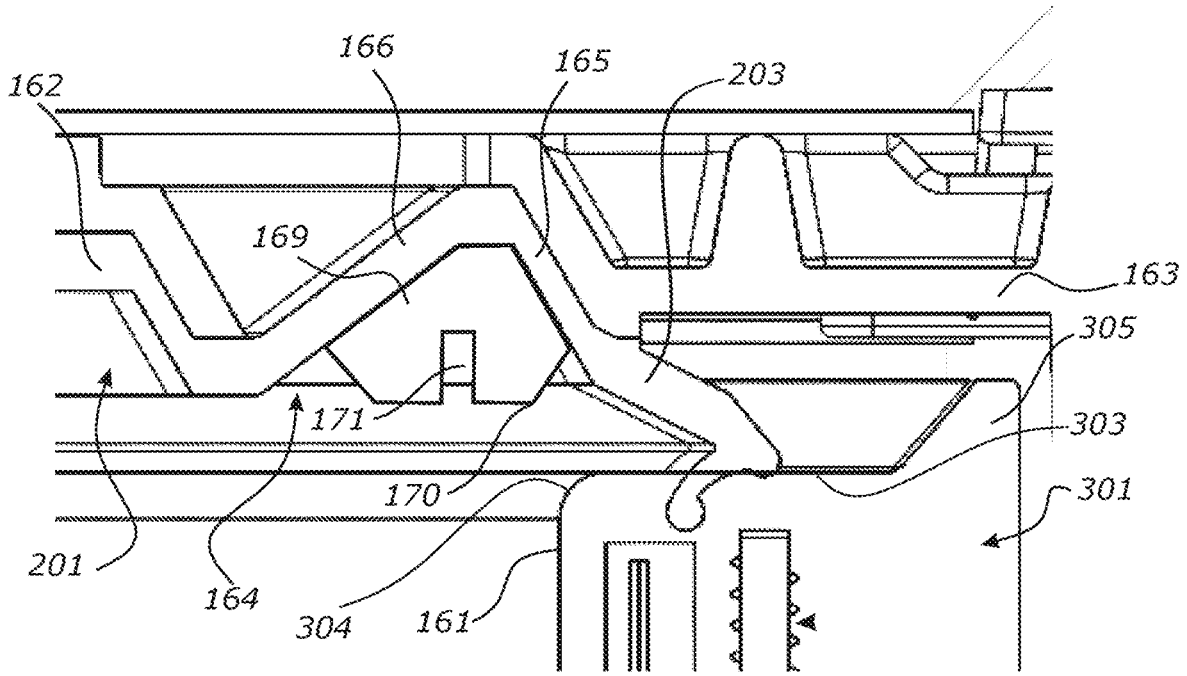
FIG. 8 is a cross-sectional view similar to FIG. 4, of the tub lid shown in FIG. 7, including a drainage facilitating rib.

With reference now to FIG. 7, an alternative design of drainage feature will now be described. On the underside of tub lid 201, at least one drainage rib 169 is provided, spanning a gap between adjacent panels of the bridging region 164. Rib(s) 169 are integrally formed with the bridging portion so are formed from a flexible material, such as an elastomeric material.

The or each rib may be substantially planar, with a width or thickness of between about 1 mm and about 2 mm, and extend in a substantially vertical plane in use, that is, a plane that is substantially perpendicular to the (substantially horizontal) plane of the central region 164 of the tub lid.

The lower edge 170 of each rib 169 is positioned to ensure that it will come into contact with at least the peripheral edge 304 of the tub flange, and preferably also at least an edge of sealing region 303, when the tub lid is lowered into sealing contact with the flange. Upon contacting the flange, rib 169 will easily deform, increasing its contact area with the flange. Thus, any pooled washing liquid near edge 304 may be contacted by a rib 169 and again, via capillary action, migrate along the rib and then drop under gravity into the tub. As illustrated, multiple ribs 169 may be spaced about the periphery of the tub lid, or they could be strategically positioned to contact peripheral edge 304 and/or sealing region 303 at one or more corner region only.

Preferably, the lower edge 170 of rib 169 is provided with a cut-out portion 171 to reduce the resistance to relative pivoting of the adjacent panels 165,166 of the bridging portion. An advantage of locating the drainage-facilitating features on the underside of lid 201 is that they are not visible.

The foregoing describes embodiments of the invention including preferred forms thereof and alterations and modifications, as will be obvious to one skilled in the art, are intended to be incorporated within the scope hereof.

The invention claimed is:

1. A tub flange member for a washing tub of a drawer of a drawer-style washing appliance, the tub flange member comprising:

an attachment side adapted to be attached to an upper edge of side walls of the washing tub, around the periphery of the tub, a seal-contacting side, opposite to and spaced away from the attachment side, including a planar region adapted to be contacted by a lid seal for closing the washing tub during a washing cycle of the drawer-style washing appliance, a peripheral wall, extending from the seal contacting side toward the attachment side, forming an opening of the washing tub at a peripheral edge between the peripheral wall and the planar region of the seal contacting side, and at least one drainage ridge or channel on or in the peripheral wall and/or the seal-contacting side, at least in the region of the peripheral edge, for channelling liquid from the seal-contacting side to the peripheral wall.

2. The tub flange member according to claim 1, wherein the tub flange member is polygonal in shape, having a plurality of side members surrounding a central opening and corner regions.

3. The tub flange member according to claim 1, wherein the tub flange member is substantially rectangular-shaped or square-shaped having a plurality of substantially straight sections joined at corner regions of the tub flange member.

4. The tub flange member according to claim 3, wherein the at least one drainage ridge or channel is provided at at least one of the corner regions of the tub flange member.

5. The tub flange member according to claim 3, wherein each corner region of the tub flange member is provided with the at least one drainage ridge or channel.

6. The tub flange member according to claim 1, wherein the at least one drainage ridge or channel extends continuously along both the peripheral wall and the planar region of the seal-contacting side.

7. The tub flange member according to claim 1, wherein the at least one drainage ridge or channel comprises plural parallel ridges, preferably three parallel ridges, protruding above the surface of the tub flange member.

8. The tub flange member according to claim 7, wherein the parallel ridges are substantially vertically aligned on the peripheral wall.

9. A washing tub for a drawer of a drawer-style washing appliance, the washing tub comprising:

a base and substantially vertical side walls, and a tub flange member according to claim 1, wherein the side walls have upper edges which support the tub flange member around the perimeter of an opening of the tub.

10. A drawer-style washing appliance comprising a cabinet and a drawer containing a washing tub, the drawer having a sliding configuration with the cabinet such that the drawer can be slid to an open position relative the cabinet to access an interior of the tub, and such that the drawer can be slid to a closed position relative to the cabinet to enable a washing operation to be performed, the tub having a tub flange member according to claim 1.

11. The drawer-style washing appliance as claimed in claim 10, wherein the drawer-style washing appliance is a dishwasher or a laundry washing machine.

12. The tub flange member according to claim 2, wherein the tub flange member is substantially rectangular-shaped or square-shaped having a plurality of substantially straight sections joined at the corner regions of the tub flange member.

13. The tub flange member according to claim 12, wherein the at least one drainage ridge or channel is provided at at least one of the corner regions of the tub flange member.

14. The tub flange member according to claim 12, wherein each corner region of the tub flange member is provided with the at least one drainage ridge or channel.

15. The tub flange member according to claim 12, wherein each corner region of the tub flange member is provided with the at least one drainage ridge or channel.

16. The tub flange member according to claim 3, wherein each corner region of the tub flange member is provided with the at least one drainage ridge or channel.

17. The washing tub according to claim 9, wherein the tub flange member is substantially rectangular-shaped or square-shaped having a plurality of substantially straight sections joined at corner regions of the tub flange member.

18. The washing tub according to claim 17, wherein at least one drainage ridge or channel is provided at at least one of the corner regions of the tub flange member.

19. The drawer-style washing appliance according to claim 10, wherein the tub flange member is polygonal in shape having a plurality of side members surrounding a central opening and corner regions.

20. The drawer-style washing appliance according to claim 19, wherein at least one drainage ridge or channel is provided at a corner region of the tub flange member.

* * * * *